US005240033A

United States Patent [19]

Erdmann et al.

[11] Patent Number: 5,240,033

[45] Date of Patent: Aug. 31, 1993

[54] DRINK DISPENSER HAVING A PIVOTED LIQUID SUPPLY TANK INCLUDING A PLUG-IN CONNECTOR ASSEMBLY

[75] Inventors: Klaus Erdmann; Ulrich Wolf, both of Munich, Fed. Rep. of Germany

[73] Assignees: The Coca-Cola Company, Atlanta, Ga.; Bosch-Siemens Hausgerate GmbH, Fed. Rep. of Germany

[21] Appl. No.: 808,583

[22] Filed: Dec. 17, 1991

[30] Foreign Application Priority Data

Dec. 17, 1990 [DE] Fed. Rep. of Germany ..... 4040394

[51] Int. Cl.[5] ..... E03B 11/00

[52] U.S. Cl. ..... 137/408; 141/352; 222/64; 222/160

[58] Field of Search ..... 141/352; 137/408; 285/231; 222/41, 52, 58, 64, 65, 66, 77, 160, 164, 166

[56] References Cited

U.S. PATENT DOCUMENTS

| | | | |
|---|---|---|---|
| 2,854,909 | 10/1958 | Dodson | 137/408 X |
| 2,861,509 | 11/1958 | Dodson | 137/408 X |
| 3,102,551 | 9/1963 | Ziegler | 137/408 |
| 3,402,747 | 9/1968 | Tissot-Dupont | 141/352 X |
| 3,460,590 | 8/1969 | Robbins | 141/352 X |
| 3,930,258 | 12/1975 | Dick et al. | 137/408 X |
| 3,972,387 | 8/1976 | Braun | 141/352 X |
| 4,132,242 | 1/1979 | Carroll, Jr. | 137/403 X |
| 4,676,149 | 6/1987 | Stover | 285/231 X |
| 4,856,676 | 8/1989 | Emody | 222/66 |

FOREIGN PATENT DOCUMENTS

| | | | |
|---|---|---|---|
| 765072 | 6/1934 | France | 137/403 |
| 789748 | 11/1935 | France | 137/408 |

*Primary Examiner*—Kevin P. Shaver

[57] ABSTRACT

The storage tank for providing liquids to a unit further processing these liquids comprises in its bottom area a plug-in connection for a drawing unit, and in the area of this elastically designed plug-in connection, a pivot bearing is placed offset to the centroidal axis of the storage tank and relative to the centroidal axis, an elastic block with an evaluating element is placed relative to the pivot bearing.

16 Claims, 1 Drawing Sheet

DRINK DISPENSER HAVING A PIVOTED LIQUID SUPPLY TANK INCLUDING A PLUG-IN CONNECTOR ASSEMBLY

BACKGROUND OF THE INVENTION

The invention relates to a tank for storing liquids and a device for drawing the liquids from this tank for further use, especially a water supply tank in a drink dispenser and a water-drawing device, in which the tank comprises in the bottom area a plug-in connecting part containing a valve, which can be connected to draw the liquid with a plug-in connecting part integrated in a support surface, over which the stored liquid can be conveyed.

Drink dispensers, which produce refreshing drinks from one or more drink concentrates and from carbonated water, can obtain the water necessary for the production of drinks directly from a water pipe connected with the dispenser. As an alternative for this purpose, drink dispensers can be supplied with water from a storage tank, for example, in the cases in which there is no water main at the site of the drink dispenser or if the quality of the water that can be drawn from the water main does not meet the special requirements for the drink to be produced.

In drink dispensers, which are supplied with water or with a drink concentrate from a storage tank, a troublefree operation depends on the fact that in each production step, sufficient amounts of the initial substances can be drawn from the storage tank.

SUMMARY OF THE INVENTION

The object of the invention is to indicate a storage tank with a drawing device of the type mentioned above, which makes possible a troublefree operation with the decreasing amount of the liquid stored in the tank.

The invention is distinguished by multiple advantages. The tanks of the drink dispensers according to the invention comprise only a plug-in valve assembly as well as an electric switch. The switch is used to turn off the drink dispenser when the amount of the stored liquids in the tank reaches a critical value assembly. Both components, valve and switch, are standard products, which can be adapted without a special matching. They interact in a simple way and assure a troublefree mode of operation.

The tank is connected in a detachable manner with the drink dispenser, so that the tank can be removed in a simple way from the drink dispenser and be refilled with the respective liquid to be stored.

An advantageous embodiment of the invention is characterized in that the tank comprises an adjusting foot on its underside, which acts on the switching contact piece of the switch. The foot concentrates the pressure starting from the tank including the respectively contained amount of liquid to an area at the tip pointing downward and thus imparts the pressure in a defined way.

According to another embodiment, the drink dispenser comprises a sealing membrane with a ram in the area of the end of the foot, which imparts the pressure starting from the foot to the switching contact element. This embodiment is distinguished by a double protection; the interior space is protected from impurities by the sealing membrane and the switching contact element of the electric switch is protected from otherwise possible damages by the foot when the tank is attached to the drink dispenser.

According to another advantageous embodiment of the invention, the switch is designed as a spring-controlled switch. With it the switch moves the tank only when reaching a certain filling level and thus when reaching a critical pressure value, while before this moment, with the amount of liquid decreasing, the tank is not changed in its position. The spring-controlled switch thus imparts stability to the storage tank. Fluctuations of the liquid in the tank and the tank itself thus do not influence the interaction of the tank and the drink dispenser.

According to another embodiment of the invention, the interior space of the tank is designed flat on its underside so that the surface from the area of the pin drops to the area of the valve. By this configuration of the tank, the pivoting of the tank around the fulcrum is supported in the valve.

Another advantageous embodiment of the invention is characterized in that the switch comprises a second switch position, which the switching contact piece produces when reaching a preset second tank pressure. The switch then triggers an alarm in its first switch position, which indicates the supply in the tank coming to an end, while in the second switch position, the drink dispenser is turned off.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF DRAWINGS

The present invention will become more fully understood from the detailed description given hereinbelow and the accompanying drawings which are given by way of illustration only, and thus, are not limitative of the present invention and wherein.

DETAILED DESCRIPTION OF PREFERRED EMBODIMENTS

Figure 1:
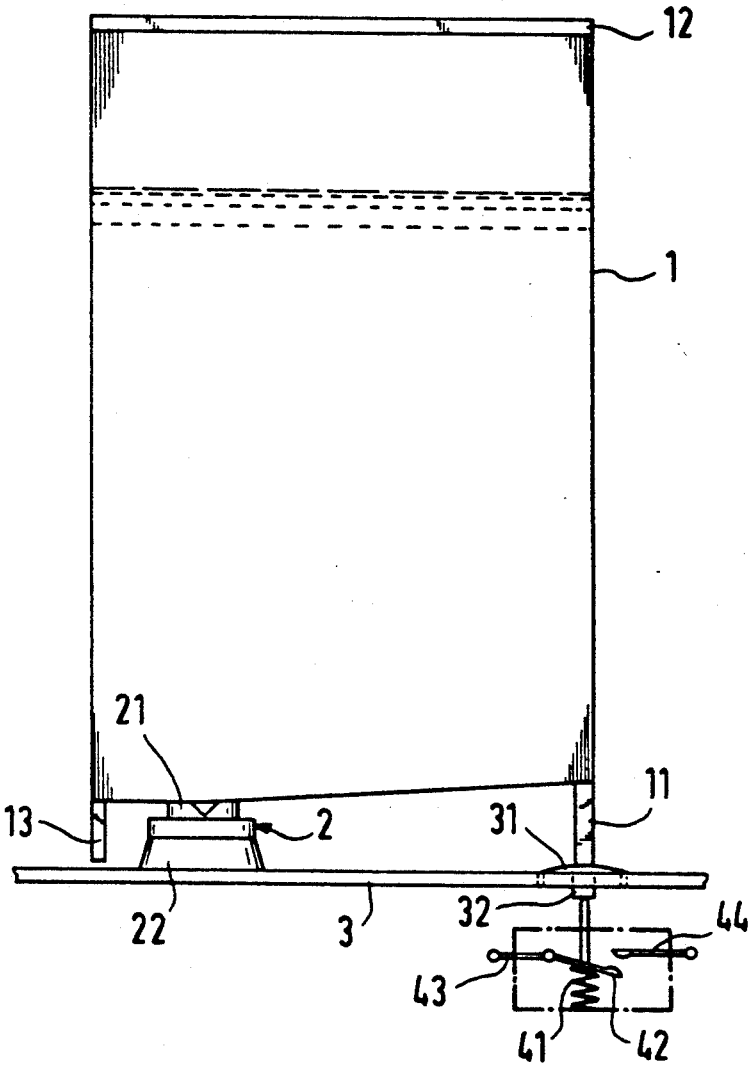
FIG. 1 is a diagrammatic view of a tank superposed in a drink dispenser.

FIG. 1 shows a tank 1 for storing water for use in a drink dispenser. Tank 1 is located on a support surface 3 of the drink dispenser and thus is brought into connection with the drink dispenser. Tank 1 is preferably designed in the shape of a parallelepiped and can be closed by a removable cover 12. The liquid stored in tank 1 is delivered into the drink dispenser by a plug-in connection assembly 2 containing a valve.

Figure 2:
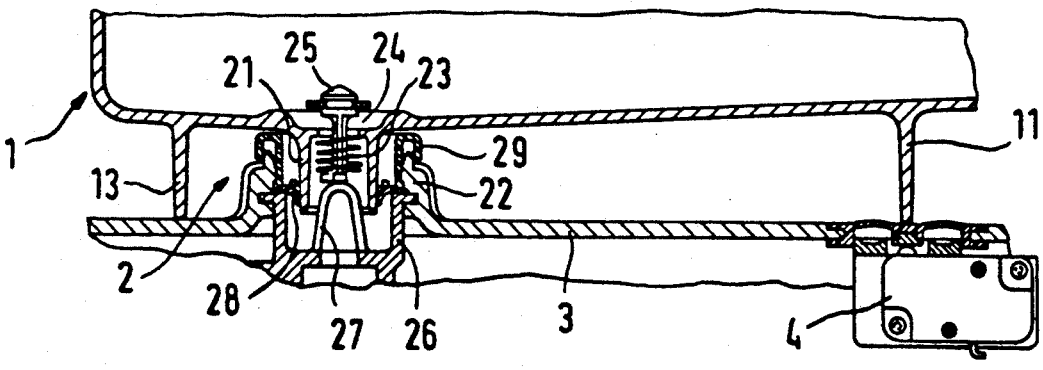
FIG. 2 a detailed view of the arrangement in the bottom area of the tank.

The plug-in connection assembly 2 containing the valve, which is described in more detail based on FIG. 2, consists of two parts 21 and 22 which can be plugged into one another. A first valve part 21 is placed on the underside of tank 1 and a second valve part 22 is placed in the support surface 3 of the drink dispenser. The valve of the assembly 2 is opened by plugging in tank 1 and closed by detaching tank 1.

The plug-in connection assembly 2 is designed as a pivot bearing and is placed offset to the pivot point of filled tank 1, so that tank 1 is mounted to swing relative to its central vertical axis on the support surface 3.

Below tank 1, preferably inside support surface 3 assigned to the drink dispenser, there is an electric switch 4, offset relative to the pivot point of tank 1, and relative to the plug-in connection. The latter comprises a switching contact element 42 that is moveable, in this case, upward (in the direction of tank 1) or downward, which is mechanically connected to its underside with a return spring 41.

Tank 1, mounted to swing in the plug-in connection assembly 2, presses against this switching contact element 42. With decreasing pressure, which starts from tank 1 including the stored liquid, return spring 41 presses switching contact element 42 and tank 1 is upward. Tank 1 thus able to swing around the fulcrum provided by the yolk member 27 in the plug-in connection part 22.

If the force due to weight on the switch starting from tank 1 falls short of a first critical value, spring 41 presses switching contact element 42 of switch 4 in a first switch position, i.e. closes electric switch 4. The closing of switch 4 is to turn off the operation of the drink dispenser and/or trigger an alarm. This can be implemented, for example, by a relay, not represented in the drawing, which is connected in series with the electrical unit or units of the drink dispenser.

An alternative not represented in the figure can be designed such that the switching contact element 42 closes the switch until the critical pressure value is reached and opens it when this pressure value is reached.

With another switch or a two-stage switch instead of described switch 4, a second switch position can be achieved, in which the turning off of the drink dispenser is triggered. In the first switch position, an alarm can be triggered, which indicates the supply in tank 1 is coming to an end.

Tank 1 comprises in particular an adjusting foot 11 on its underside, which acts on switching contact element 42. The length of adjusting foot 11 is to be dimensioned relative to valve part 21 placed on the underside of the tank and optionally additional adjusting feet or supports 13 on the underside of the tank so that tank 1 detached from drink dispenser support surface 3 can safely be set down on a flat surface.

In the embodiment represented in FIG. 1, support surface 3 includes a sealing membrane 31 with a ram 32, which transfers the pressure starting from adjusting foot 11 to switching contact element 42.

Switch 4 is preferably designed as a spring-controlled microswitch switch to impart stability to tank 1 relative to fluctuations of the liquid in the period before reaching the critical pressure value or values.

The interior space of the tank is designed flat on its underside in such a way that the surface in the area of adjusting foot 11 plants downwardly to the area of the plug-in connection assembly 2. The movement of tank 1 around its fulcrum element 27 of the plug-in connection part 22 is supported by these embodiments.

FIG. 2 shows plug-in connection assembly 2 between storage tank 1 and support surface area 3 in its preferred embodiment. The plug-in connecting elements are configured basically rotationally symmetrical as shown. It can be seen that on support surface 3, the plug-in connecting part 22 is designed as a pipe socket. There a pipe socket molded on the bottom of storage tank 1 projects upwardly toward the plug-in connecting part 21 of the tank. A poppet valve 25 able to be lifted against the force of a spring 23 upward from a valve opening 24 is located in plug-in connecting part 21 assigned to storage tank 1. An insert 26 is placed in plug-in connecting part 22 and connected to support surface 3 and includes a dome-shaped yoke 27. Then, if storage tank 1 is superposed or the support surface 3 and plug-in connecting parts 21 and 22 engages each other, the poppet valve 25 is raised upward by the yoke 27 and as a result, valve opening 24 is opened, so that the water stored in storage tank 1 can flow downward into the area of insert 26, the area from which it is discharged for further in the drink dispenser or is suctioned off by a feed pump. An elastic sealing element 28 seals both plug-in connecting parts 21 and 22 against one another. By the embodiment of this sealing element 28, the sealing action is reinforced by the water pressure occurring in this area. The upper edge of the plug-in connecting part 22 connected to support surface 3 is closed with a ring-shaped cap 29 made from elastic material. Storage tank 1 is able to be supported on this ring-shaped cap 29 relative to support surface 3 so that an elastic swivel axis would be formed in this area. In such an embodiment, adjusting foot 13 of storage tank 1 does not contact with support surface 3 as shown in FIG. 1.

However, with an alternate embodiment as shown in FIG. 2, this adjusting foot 13 of the storage tank rests on support surface 3, so that the swivel axis for storage tank 1 is formed at the contact point where the foot 13 touches the surface 3. By the tilting movement of the storage tank, plug-in connection 2 lying in the immediate vicinity undergoes only extremely slight movements against one another relatively insignificant for their function. The bottom area of storage tank 1 in these cases is not supported or is hardly supported on ring-shaped cap 29 of plug-in connection 22.

On the side opposite plug-in connection assembly 2 relative to the vertical control axis of storage tank 1, the storage tank 1 is always supported by the adjusting foot 11 with water-filled condition laterally from the elastic membrane 31 directly on charging surface 3. Adjusting foot 11 extends—just as adjusting foot 13—in the direction of the top view of FIG. 2 below storage tank 1, namely over the opening covered by sealing membrane 31 beyond support surface 3. First, if storage tank 1 is basically empty, a spring element specific to switch 4 is able to raise the correspondingly substantially emptied storage tank 1 by its adjusting foot 11, by which also an electrical switching function is made, which is implemented by switch elements 41 and 42.

The closer the swivel axis for the storage tank is placed to its central vertical axis, the lower the spring power that can be used in the area of the switch.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. Apparatus for delivering a liquid from a supply tank to a post-mix drink dispenser, comprising:

a supply tank support surface member;

a plug-in valve assembly including a first and a second part, said first part being located in a bottom portion of the tank and offset from one side of a central vertical axis thereof, said second part being located in an adjacent portion of said support surface member;

a switch actuator located on said bottom portion of the tank and offset from the other side of the central vertical axis;

an electrical switch located adjacent the switch actuator on said support surface member and being actuated by a tilting of the tank about a fulcrum point on said one side of the central vertical axis due to the weight of the liquid in the tank, said first part of the valve assembly further comprising a normally closed valve including a spring biased valve stem and a bias spring therefor located in a bottom wall of the tank, and a downwardly projecting segment of a pipe surrounding said valve stem and said bias spring;

said second part of the valve assembly further comprising a pipe socket structure for receiving said first part of the valve assembly and including an internal domed shaped yoke, said yoke being operable to open the valve upon contact with said valve stem; and a sealing element located between said yoke and said pipe segment.

2. The apparatus as defined by claim 1 wherein said second part additionally includes an upwardly projecting ring-shaped cap surrounding said pipe segment for supporting the bottom wall of the tank.

3. The apparatus as defined by claim 2 wherein said sealing element is comprised of elastic material.

4. The apparatus as defined by claim 2 wherein said ring-shaped cap is comprised of elastic material.

5. The apparatus as defined by claim 2 wherein both said sealing element and said ring-shaped cap are comprised of elastic material.

6. The apparatus as defined by claim 2 wherein said tank additionally includes a foot member projecting downwardly from said bottom portion on said one side of the central vertical axis and on the other side of said first and second parts of the valve assembly.

7. The apparatus as defined by claim 6 wherein said fulcrum point is coincident with said first and second parts of said valve assembly.

8. The apparatus as defined by claim 6 wherein said foot is located in a peripheral region of said bottom portion and adjacent said first and second parts of the valve assembly.

9. The apparatus as defined by claim 8 wherein said foot extends to and touches said support surface member.

10. The apparatus as defined by claim 9 wherein said fulcrum point comprises a point where said foot touches said support surface member.

11. The apparatus as defined by claim 1 wherein said switch actuator comprises an adjusting foot peripherally located on said other side of the central vertical axis.

12. The apparatus as defined by claim 11 wherein said support surface member includes a sealing membrane and said adjusting foot couples to said electrical switch through said sealing membrane.

13. The apparatus as defined by claim 1 wherein said electrical switch comprises a spring biased switch.

14. The apparatus as defined by claim 13 wherein said switch comprises a normally closed switch device which is opened by said switch actuator due to the weight of said liquid.

15. The apparatus as defined by claim 13 wherein said switch actuator comprises a foot member projecting from a bottom portion of said tank.

16. The apparatus as defined by claim 14 wherein said switch comprises a microswitch.

* * * * *